US005533694A

United States Patent [19]

Carpenter

[11] Patent Number: 5,533,694

[45] Date of Patent: Jul. 9, 1996

[54] METHOD FOR LOCATING THE RESULTANT OF WIND EFFECTS ON TETHERED AIRCRAFT

[76] Inventor: Howard G. Carpenter, 7667 Kelley Dr., Apt. 13, Stockton, Calif. 95207

[21] Appl. No.: 207,595

[22] Filed: Mar. 8, 1994

[51] Int. Cl.[6] ..... A63H 27/08; B64C 31/06

[52] U.S. Cl. ..... 244/153 R

[58] Field of Search ..... 244/153 R

[56] References Cited

U.S. PATENT DOCUMENTS

| | | | |
|---|---|---|---|
| 2,751,172 | 6/1956 | Rogallo et al. | 244/153 R |
| 4,018,407 | 4/1977 | Aber | 244/153 R |
| 4,216,929 | 8/1980 | Holland, Jr. | 244/153 R |
| 4,927,100 | 5/1990 | Provenzo, Jr. et al. | 244/153 R |

*Primary Examiner*—Karen B. Merritt
*Assistant Examiner*—Virna Lissi Mojica

[57] ABSTRACT

A method for the determination of the location of the line-of-action of the resultant of the wind forces on a tethered aircraft is disclosed. The location is referenced to a line-segment that is referenced in turn to the aircraft structure. The line-segment is from the point of attachment of the tether to the center-of-gravity of the aircraft. The location is the distance along the line-segment from the center-of-gravity to the point of intersection of the resultant and the line-segment and the angle between them. The method includes the measurement of the length of the line-segment and the measurement of the aircraft weight. While the aircraft flys in force equilibrium, measurements of the tether-tension, of the inclination of the tether, and of the slope of the line-segment are recorded. The measurements provide locations of a plurality of coordinate points on the line-of-action. The resultant that is located by the points is marked on or within the structure. The location is a property of the tethered aircraft. Once marked, whatever the angle of attack, the location remains fixed, however the site of the towing-point or the weight distribution is altered.

14 Claims, 3 Drawing Sheets

METHOD FOR LOCATING THE RESULTANT OF WIND EFFECTS ON TETHERED AIRCRAFT

BACKGROUND—FIELD OF THE INVENTION

This invention relates to any tethered aircraft, specifically to a method for the determination of the location of the line-of-action of the resultant of the wind effects that lift and drag any tethered aircraft.

BACKGROUND—DESCRIPTION OF PRIOR ART

C. F. Marvin prepared the monograph, "The Mechanics and Equilibrium of Kites," for which he received the "Chanute Prize" within a year of May 27, 1896. Marvin, Professor of Meteorology, U.S. Weather Bureau, submitted his monograph with the approval of Prof. Willis L. Moore, Chief of Weather Bureau.

Octave Chanute, Esq., ex-president of the American Society of Civil Engineers authorized the Boston Aeronautical Society to award a special prize of $100 "for the best monograph on the kite, giving a full theory of its mechanics and stability, with quantitative computations appended."

Marvin gave complete due consideration to the points 1 to 4 specified in the announcement of the Chanute prize. Points 1 and 2 are quoted here as pertinent to the prior art.

"1. The resolution of all the forces acting upon an ordinary kite with a tail; i.e., the wind pressure upon its surface, its tail, and its string, and the weight (gravity) of these various parts. The resulting equilibrium, or the diving, spinning round, or glancing sideways, and how the forces act which restore the balance. State the position of the center of gravity, center of pressure, and best point of attachment for the string, with numerical example."

"2. Give the same elements for the tailless kite, distinguishing between the Malay, the Japanese or Chinese, the Bi-polar, the Hargrave, and the Fin (Boynton) kites. Indicate also what are the general principles upon which each group of the tailless kites depends for its stability."

In his monograph Marvin combined the forces resulting from the action of the wind upon all the parts of the kite with the weight and the force exerted at the kite due to wind force and gravity upon the tail. According to Marvin these wind forces and gravitational forces are independent forces; "The restraining pull of the line . . . , is not an independent force, but exists as a result of the combined action of the other forces. This pull of the kite line is the force that is to put the whole system of forces in equilibrium." Tether pull is a dependent force.

Marvin held that the concept of a center of pressure was invalid for kites and so he defined the central axis, "It is a line, not a point, we are to think of in this connection as having some mechanical significance." He cites the fundamental proposition of mechanics, "When a system of forces has been reduced to a single force and a couple there is but one position of the force possible in which the axis of the couple will be parallel to the direction of the force. This position of the force is called the central axis of the system." Marvin's symbol for the single force of the central axis is "$R_o$".

The tension in the string is equal and opposite and collinear with the central axis, and when the couple has vanished, is zero, the string will hold the kite in equilibrium.

The "string" is the tether. The place of attachment of the tether to the kite or to its bridle is the towing-point.

The several partial effects of the wind upon the different members of the kite structure that Marvin combined are, "namely: the resultant normal pressure of the wind upon the sustaining surfaces, N; the total effect of the wind upon the framework, f; the total pressure effect of the wind upon the edges, e; the excess of pressure upon one side of neutral surfaces, n; the total effect due to waves and fluttering, w; and, finally, any effect due to the presence of eddies or vortex motions, v, can all be combined in a simple manner by aid of the graphic methods employed in mechanics." The combined partial effects of the wind is "the single force, R', . . . and the couple Z'". (After omission of the superscript, Marvin's single force R' is the wind-resultant force R of this description.)

"It is to be noticed that each one of these effects, for example, the resultant pressure of the wind upon the framework, is the resultant of a complex system of forces and according to our fundamental principle each system is reducible to a single resultant force and a couple in a plane perpendicular to the force."

Marvin precludes coplanarity among these resultants, "These resultant forces are not necessarily in the same plane as the principal wind pressure N, nor even parallel to such a plane. Moreover, we can not assign, a priori, any fully logical relation between the position and magnitude of any one of these resultants and those of another or the resultant N. But this is not of any consequence,"

However, in variance with Marvin, the reader will see in the description below that coplanarity in equilibrium flight is essential to this invention.

Other forces listed by Marvin are force (2) gravity and force (7) the pull of the tail whenever it is used. According to Marvin, forces (2) and (7) are "not necessarily in the same plane" as single force R' . . . "on the average the tail will generally dispose itself in a vertical plane, and the forces (2) and (7) might, therefore, be regarded as in the same vertical plane; but there is no advantage in thus specializing our analysis, and we will, therefore, regard forces (2) and (7) as in different planes." The above quotations are from C. F. Marvin's monograph.

Among kite flyers the procedure for siting the towing-point remains a trial and error art, because there is scant or no reference to a dimensional property of a kite. Quoting David Pelham, Penguin Book of Kites, "The accepted average setting for a bridle is arrived at by laying the kite upon its back, and, having attached the bridle line to the bridling points fore and aft of the spine, lifting the top end of the kite by suspending the bridle loop over one finger. By maneuvering the line until the tail end of the kite is at an angle between 20° and 30° from the floor the point on the bridle at which the kite now balances at this angle should be established. A towing ring should then be attached to this point by means of a lark's head hitch." Thus the towing-point is set.

This technique is only vaguely related to the center of gravity, c.g., of the kite and even more vaguely related to some imagined center of pressure, c.p. The location of the towing-point is adjusted after each of several trial flights until the kiter finds an acceptable location of the towing-point for his desired flight.

This trial and error procedure for siting the towing-point is a disadvantageously limited prior art. It is limited, because there is no reference point or line on the kite, against which to project improvements, or to characterize failures. It is disadvantageous, for without utilization of reference properties, designs for mechanization are also limited to trial and error techniques.

It is explained in the description below that the location of the central axis relative to the structure of a kite is not a property of the kite. Therefore a concept of a location of Marvin's central axis is invalid and lacks advantage in that it is not a location that provides a useful basis for advances in kite design and performance.

Because the central axis $R_o$ is not a property of the kite, the central axis is not useful for rigging ordinary kites. The procedure for siting the towing-point remains, until now, a trial and error art with scant or no reference to a dimensional property of a kite.

Marvin's theory was, in his time, an advantageous conceptual basis for advances in kite design and performance, and it did concern those who would develop the airplane. Yet his theory, perhaps for the sake of its breadth, excludes the case of the coplanarity of forces on a kite in equilibrium flight. This exclusion of the consideration of the coplanarity of forces on a kite, especially as applied to a kite in equilibrium flight, is taken to be a disadvantageously limiting prior art feature of Marvin's theory.

Because Marvin's central axis $R_o$ is a property of the tether and hence not a property related to the structure of the kite, the system of forces that Marvin described is not related to the structure of the kite.

The system of forces on a tethered aircraft in equilibrium flight is entirely determined when the magnitude and inclination of the wind-resultant force is calculated from measured values of the weight, the tether tension, and the inclination of the tether. But Marvin's system only relates one force to another. His determined system is not related to the aircraft; his measurements produce the same resultant $R_o$ for equilibrium flights having different attitudes, angles of attack.

The determined system of forces is unrelated to the aircraft unless it is indexed to the structure, a member such as a longeron.

That Marvin's central axis is not related to structure is the deficiency, is the lack, in the prior art that is addressed by this invention.

SUMMARY—RESULTANT OF WIND EFFECTS

The location of the line-of-action of the wind-resultant force is a property of the aircraft, whereas C. F. Marvin's central axis is a property of the tether. Although the wind-resultant force is a component of the central axis the location of the central axis is not fixed with respect to the body of the aircraft. It is realized that evaluation of this property of the aircraft is valuable to scientists, engineers, aviators, and kiters in general, consequently, this method for locating, quantitatively, wind-resultant force R with respect to the structure of a tethered aircraft, a kite, is invented.

It is explained below that the location of the action line of wind-resultant R is a property of the kite, for the location is the same for all angles of attack. Eventhough the property, wind-resultant R, is a component of C. F. Marvin's central axis $R_o$, the location of central axis $R_o$ itself is not a property of the kite. The line-of-action of central axis $R_o$ is the center line of the tether prolonged; central axis $R_o$ is a property of the tether. So that the technological value of knowing the location of wind-resultant R, an aircraft property, is high, whereas no like technological value pertains to central axis $R_o$, for axis $R_o$ is not a property of a tethered aircraft.

Furthermore, it is realized that when a tethered aircraft flys in equilibrium in a steady wind that the line-of-action of the wind-resultant force R lies within a vertical plane. In flight, the action line of the resultant slopes to the leeward. The plumb line through the center-of-gravity shares the vertical plane with the resultant, so that the lines intersect. Force resultant R and the weight are independent forces on the aircraft, whereas the force that puts the system in equilibrium, the tension in the tether, is dependent. The three forces, resultant R, the weight, and the tension are coplanar when flight is in equilibrium.

Because, as cited in the Prior Art, C. F. Marvin chose to neglect coplanarity, a proving demonstration is provided hereinafter that shows that the three equilibrium forces are indeed coplanar in a vertical plane, the coplane, and, moreover, it is shown that the forces are concurrent. In equilibrium the lines of action of the forces cross through a single point, the concurrent point.

The interconnecting line-segment between the center-of-gravity and the towing-point lies within the vertical plane, the coplane, since both these points lie on their action lines within the plane. In equilibrium flight the line-of-action of the wind-resultant force crosses through the concurrent point and, also, intersects the interconnecting line-segment, and so the line-of-action of the resultant is located within the coplane. The resultant having been located relative to the line-segment which itself is located relative to the structure via the center-of-gravity, the resultant is, in turn, located on or within the structure of the aircraft; so that the purpose of this method is accomplished.

SUMMARY—STEPS IN THIS METHOD

The site of the towing-point is determined during preflights.

While the aircraft is on the ground;

all measuring, and recording instrumentation is installed the location of the center-of-gravity of the instrumented aircraft is recorded the weight of the instrumented aircraft is recorded the length of the line-segment is measured and recorded While the aircraft flys in stall in force equilibrium in a steady wind;

the slope of the line-segment is measured and recorded the tether-tension is measured and recorded the tether inclination angle is measured and recorded The recorded weight, length, slope, tension, and inclination are operated on by any calculator mechanism for the determination of the location of the line-of-action of the wind-resultant force on or within the structure of the tethered aircraft. The located line-of-action marked on or within the structure of the aircraft, and, once marked, the location remains fixed relative to the structure whatever the angle of attack.

OBJECTS AND ADVANTAGES

The object of the present invention is to provide a method for marking an actual, physical line that is the line-of-action of the wind-resultant force on or within the structure of a tethered aircraft flying in force equilibrium.

A basic advantage is that the fixed inscribed line is a useful reference line for structural, configurational improvements in tethered aircraft.

The location of the line-of-action provided by this method makes a useful, new-to-use, reference line available to kiters.

An advantage of a known location of a reference line is that the siting on the aircraft of the towing-point becomes rational—not by trial.

Advantages derive from this method, because the line-of-action that is located is a property of the tethered aircraft. The line-of-action is an advantageous property because its location relative to the structure of the aircraft is unchanged, within a range, however the in-flight angle of attack is changed.

The location of the line, this property, advantageously correlates to the flight characteristics of the tethered aircraft.

Another advantage is that the fixed line-of-action of the resultant of the wind forces is a useful reference for other lines-of-action that ensue, those that are projected or that are detected, that arise in consequence of subsequent alterations in aerodynamic configurations.

Another advantageous use of the line-of-action of the wind-resultant that is located by this method is in the indexation of coordinate systems relative to the body of an aircraft. The action lines of the forces, tether tension, weight, and wind-resultant, are readily correlated by a coordinate system on the coplane or a diagramatic image of it.

Yet another advantage of the result of this method is that the action lines of the forces, tether tension, weight, and wind-resultant, are located relative to the center of gravity, a determinable point within the body of the tethered aircraft, thereby reliance on varying and undefinable boundries of the tethered aircraft body is eliminated.

Still another advantageous feature of this method is that it is operable with unchanging effectiveness independently of the wind velocity. Eventhough the velocity and direction of the wind must be unchanging during a period of measuring, a set of these measurements taken in wind of any velocity is valid.

It is an advantage that it is unnecessary to measure the velocity of the wind; it is only necessary that a set of in-flight measurements be taken at a single wind velocity. The location of the resultant of the wind forces on a tethered aircraft found by using this method in wind at one velocity is the same as that location found in another wind at a different velocity.

An advantageous feature is that the validity of a location determined from a set of measurements taken in wind of one velocity is proved by comparison of identicalness with the result from another set taken at a different wind velocity.

Further objects and advantages realized from this method are that it facilitates aerodynamic improvements in the design of kites and tethered aircraft; and that it enables and consequently stimulates the application of mechanical and electrical technological advances in kiting, and in so doing enhances developmental aspects of flight control. It is also an advantage that the method is employable with the same effectiveness inside a wind tunnel as outdoors in the wind. Still further objects and advantages will become apparent from a consideration of the ensuing description and drawings.

DRAWING FIGURES

REFERENCES IN DRAWINGS

Figure 1:
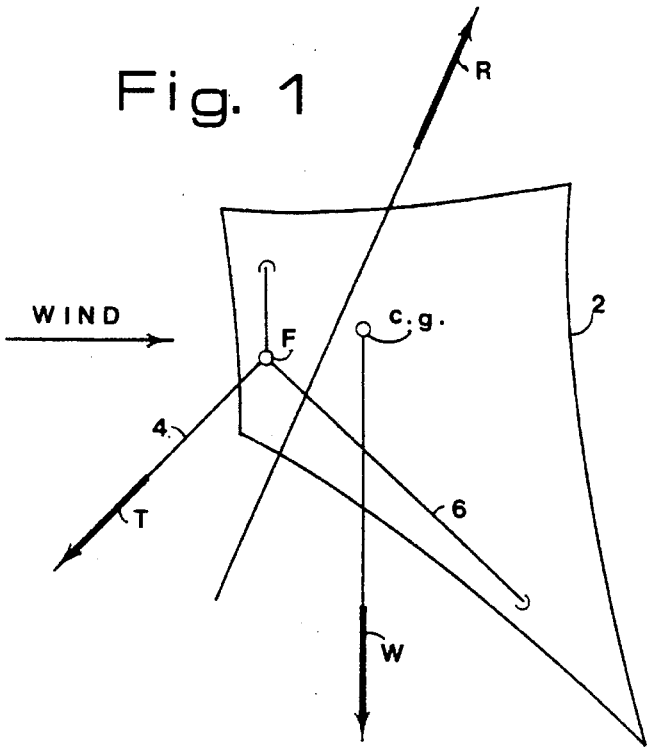
FIG. 1 is a picture of a kite aloft in the wind and the forces on it.

2 kite
2A portion of kite
2B spine of kite
4 tether
6 bridle
8 line-segment
10 tension-sensor
12 flexible conductors, tension-sensor
14 tension-recorder
16 angle β sensor
18 hangers
20 angle β recorder
22 pendulum, angle β sensor
22A pendulum bob, angle β sensor
24 flexible conductors, angle β sensor
26 angle f sensor
26A parallel to line-segment 8
28 conductors, angle f sensor
30 angle f recorder
32 pendulum, angle f sensor
32A pendulum bob, angle f sensor
34 moment arm
c.g. center-of-gravity in figures
cg center-of-gravity in description
F towing-point
W force vector, weight
T force vector, tether-tension
R force vector, wind-resultant
R' force vector, wind-resultant
$R_o$ force vector, central axis
$R_{T\&W}$ force vector, replacement of forces T and W
C concurrent-point of forces
MN a plane, vertical coplane
J a point, intersection of action line of wind-resultant R and line-segment 8, intersection-point
$(X_1, Y_1)$ coordinates of towing-point F
$(X_2, Y_2)$ coordinates of center-of-gravity cg
L length of line-segment 8
distance between points c.g. and J
β angle, tether-inclination, "beta"
f angle, slope of line-segment 8
ω angle of intersection of wind-resultant R with line-segment 8, "omega"

DESCRIPTION, FIGS. 1 to 10

In FIG. 1, kite 2 is pictured flying in force equilibrium in steady wind, a wind whose velocity and direction are unchanging during a period of time, in which wind kite 2 is neither rising or descending, nor traveling to the left or to the right, nor twisting about.

Eventhough kite 2, pictured in FIG. 1, is an Eddy type bowed diamond kite, the method in this invention applys equally to all kites, such as flats, boxes, compound cellulars, parafoils, and deltas. Tethered aircraft supported by wind are kites. Tethered propeller or jet powered fixed or rotary wing airplanes, towed gliders, and towed balloons are kites.

In this description, a reference to a particular kite in a particular Figure includes a reference numeral, e.g. kite 2, but in a general statement that applys to all kites a reference numeral does not trail the word "kite".

The arrows in FIG. 1 are force vectors R, T, and W superposed on the picture of kite 2. Vector R is wind-resultant force R. Vector W is weight W of kite 2. Vector T is tension T in tether 4.

The total pressure effect of the wind upon the entire structure of a kite flying in force equilibrium is the wind-resultant R. The lifting and dragging wind forces on a tethered aircraft flying in force equilibrium is wind-resultant R. In FIGS. 1, 3, 4, 5, and 7 the center-of-gravity cg of the tethered aircraft is shown to lie on the vertically downward line-of-action of weight W, the plumb line. The line-of-action of tether-tension T is tangent to the center line of tether 4 at towing-point F. In FIG. 1, tether 4 is shown connected to bridle 6 at Towing-point F. Towing-point F is on the body of the kite when the kite is without a bridle (not shown).

Figure 2:
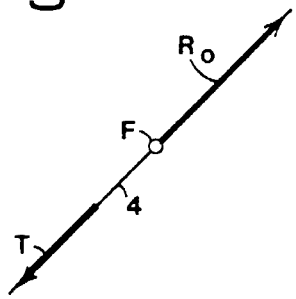
FIG. 2 shows that tether-tension T is equal and opposite and collinear with central axis $R_o$.

In FIG. 2 Marvin's central axis R is shown to be a vector that is equal and opposite in direction to and collinear with the tension T in tether 4 at towing-point F.

Figure 3:
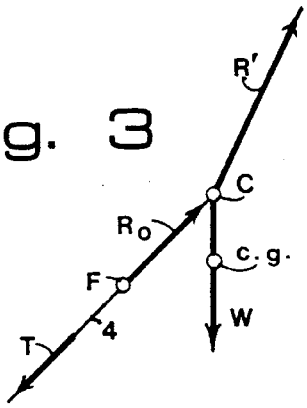
FIG. 3 is a diagram of concurrent forces on a kite.

In FIG. 3, Marvin's central axis $R_o$ is resolved into components R' and W at point C on the plumb line, the action line of weight W. It is significant that component R' is not collinear with tension T. It is shown in FIG. 3 that the slope of R' is different from the slope of tension T; the excess of the slope of R' over the slope of tension T is a function of weight W. After omission of the superscript, Marvin's R' is wind-resultant R. This method, for locating wind-resultant R, is in accord with Marvin's assertion that when a kite flys in equilibrium the lines of action, at the kite, of tether-tension T and the central axis $R_o$ are collinear. The moment $Z_o$, defined by Marvin, is zero when flight is at equilibrium. Tether 4 is shown connected at towing point F in all FIGS.

Figure 4:
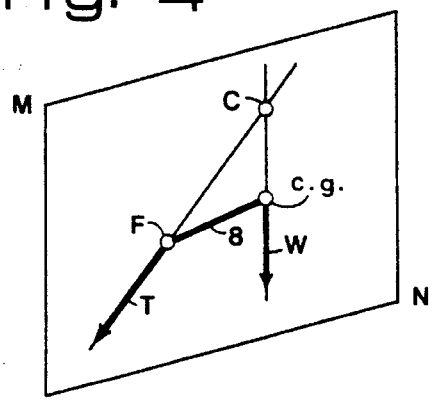
FIG. 4 is a picture of coplane MN and tether-tension T and plumb-line W and line-segment 8 within it.

The prolonged, negative line-of-action of tether-tension T necessarily intersects the vertical line-of-action of weight W at point C, the point of resolution of $R_o$, FIG. 3. The two intersecting lines, tension T and the plumb line of weight W through C, determine vertical coplane MN that is shown in FIG. 4. The parallelogram in FIG. 4 represents coplane MN which is regarded as transparent. Coplane MN is vertical, because vector W, the plumb line within it, is vertical.

It is shown in FIGS. 1 and 3 that center-of-gravity cg lies on the action line of weight W and towing-point F lies on the action line of tether-tension T. Because these action lines determine coplane MN, the points cg and F on these lines lie within coplane MN. Since points cg and F are within coplane MN, line-segment 8, FIG. 4, between points cg and F is also within coplane MN.

Center-of-gravity cg and towing-point F are fixed points within the structure of a tethered aircraft. Line-segment 8 is then a fixed line of reference within the structure of the aircraft, because line 8 lies between points cg and F. Consequently, when the action line of resultant R with respect to line-segment 8 is located, resultant R is also located with respect to the structure or body of the aircraft.

Figure 5:
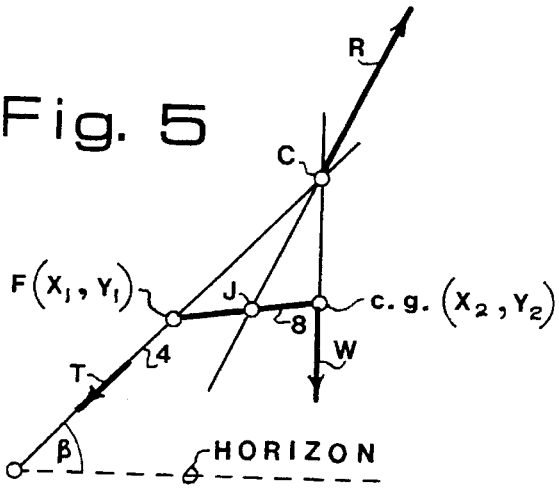
FIG. 5 is an orthogonal profile of the concurrent forces with respect to line-segment 8 that connects the center-of-gravity cg to the towing-point F.

FIG. 5 is an orthogonal profile of an equilibrium of forces R, T, and W on a tethered aircraft aloft in steady wind. Forces R, T, and W are concurrent at point C on the plumb line of W. Tether 4 is connected at towing-point F. The inclination of tether 4 with respect to the horizon is angle β. A coordinate system is superposed on the profile. Towing-point F at coordinate point $(X_1, Y_1)$ is on the action line of tension T. Center-of-gravity cg at coordinate point $(X_2, Y_2)$ is on the plumb line. Line-segment 8 is between center-of-gravity cg and towing-point F. The line-of-action of wind-resultant force R intersects line-segment 8 at point J.

Figure 6:
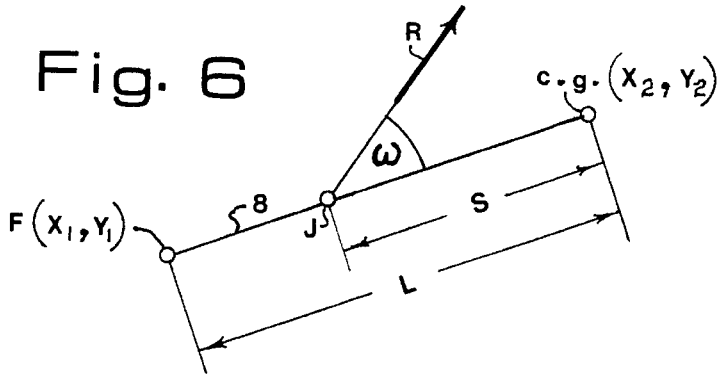
FIG. 6 shows the location of wind-resultant R relative to line-segment 8.

FIG. 6 is an orthogonal profile of line-segment 8 and wind-resultant R. It is shown that the coordinate point $F(X_1, Y_1)$, the towing-point, is on the left end of line-segment 8 and the center-of-gravity cg, point $cg(X_2, Y_2)$, on the right end. In FIG. 6 as in FIG. 5 the line-of-action of wind-resultant force R intersects line-segment 8 at point J. The angle of intersection is ω. The dimension of line-segment 8 is the length L. The distance of intersection point J from center-of-gravity cg is the dimension S.

Angle ω and distance S are the location of resultant R with respect to line-segment 8. Line 8 is referenced to the aircraft. So that the method is accomplished; resultant R is located, via line-segment 8, with respect to the body of the aircraft.

The advantageous utility of the reference, line-segment 8, is that it is a property of the aircraft that is readily determined with unlimited accuracy. The location of line 8 is the same for every flight in wind of any velocity provided that the location of towing-point F is unchanged and the location of the center-of-gravity is unaltered by addition or removal or relocation of weight.

Figure 7:
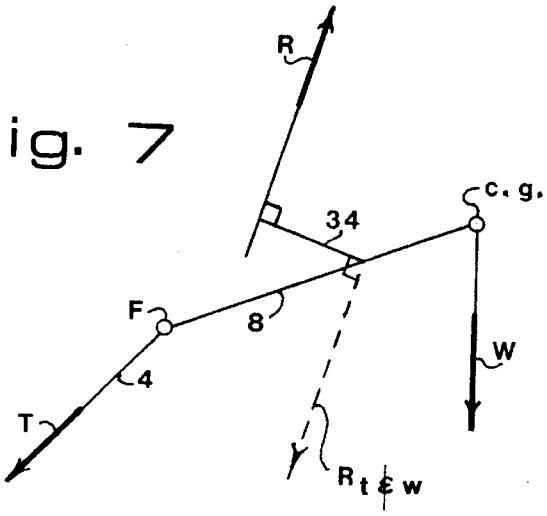
FIG. 7 shows a couple about line-segment 8.

FIG. 7 is a diagram of a couple about line-segment 8. Line-segment 8 is between towing-point F and center-of-gravity cg. Tether 4 is connected to towing-point F. The vectors, tether-tension T in tether 4 and weight W, are replaced by the single force $R_{T\&W}$, shown by the dashed line in FIG. 7. In FIG. 7 the line-of-action of wind-resultant R does not intersect line-segment 8. But force vector $R_{T\&W}$ does intersect line-segment 8. It is shown in the diagram that the force $R_{T\&W}$ is equal in magnitude, parallel to, and opposite in direction to wind-resultant force R. The action line of force R is separated from the action line of force $R_{T\&W}$ by the length of the common perpendicular, line-segment 34. The forces R and $R_{T\&W}$ and the line 34 constitute the couple.

Figure 8:
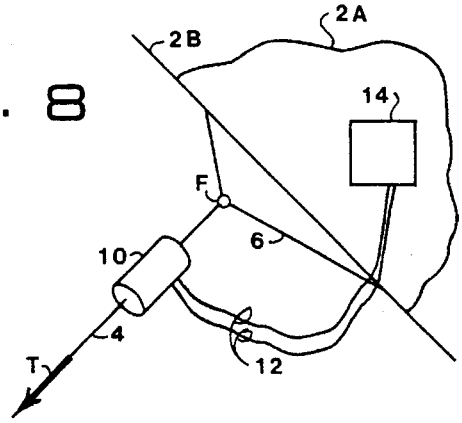
FIG. 8 shows the tether-tension T measuring and recording system installation on a tethered aircraft.

The installation of tether-tension T measuring and recording system is shown in FIG. 8. Tension-sensor 10 includes any of a variety of perfected devices for measuring tension in a cord. Sensor 10 is mounted within and supported from tether 4 near the top end of tether 4, adjacent to towing-point F on bridle 6. Tension-sensor 10 inputs measurements of tether-tension T via flexible conductors 12 to tension-recorder 14. In FIG. 8 tension-recorder 14 is shown mounted on portion 2A of the body of the tethered aircraft, kite 2, FIG. 1. Longeron 2B is a spine of kite 2, FIGS. 8, 9, and 10.

Figure 9:
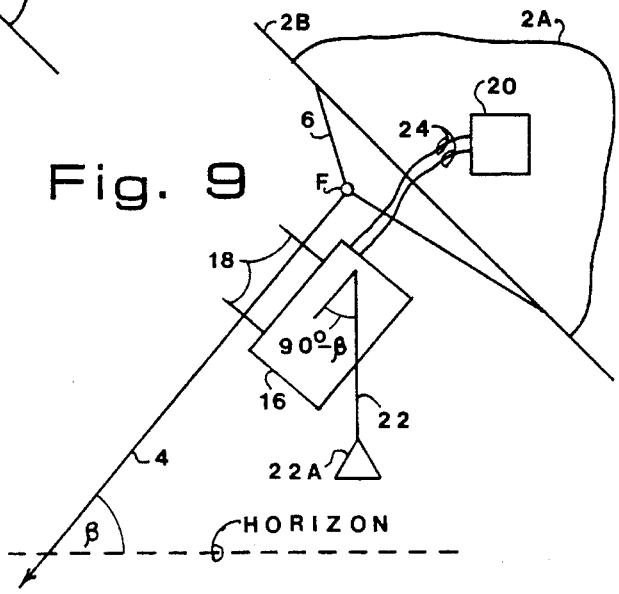
FIG. 9 shows the inclination-angle β measuring and recording system installation on a tethered aircraft.

The installation of tether-inclination angle β measuring and recording system is shown in FIG. 9. Angle β sensor 16 includes any of a variety of perfected devices for measuring angles. Angle β sensor 16 is suspended and supported from tether 4 by hangers 18 near the top end of tether 4, adjacent to towing-point F on bridle 6. Angle β sensor 16 inputs measurements of inclination angle β via flexible conductors 24 to angle β recorder 20. In FIG. 9 angle β recorder 20 is shown mounted on portion 2A of the body of the tethered aircraft, kite 2, FIG. 1. The horizon, the initial side of angle β, remains fixed as the tethered aircraft proceeds toward equilibrium altitude. The terminal side of angle β is tangent to tether 4. It rotates about the vertex of angle β and is 90°-β from vertical. The vertex of angle β is at or near the top end of tether 4 The fixed initial side of angle β is accomplished by pendulum 22 with bob 22A as shown as part of sensor 16, FIG. 9.

Figure 10:
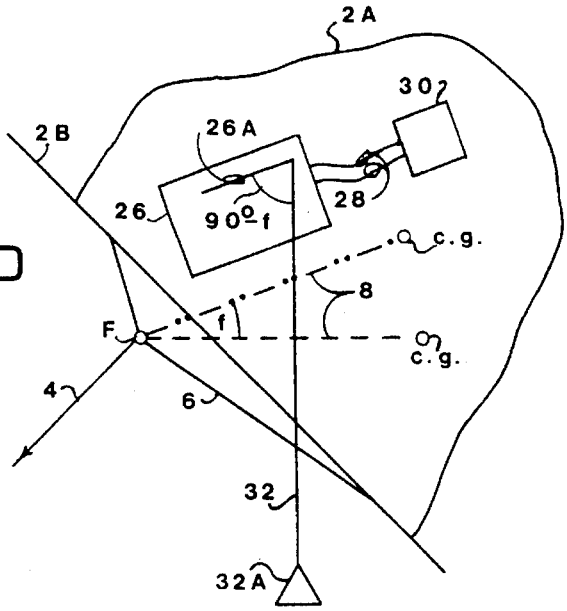
FIG. 10 shows the angle f measuring and recording system installation on a tethered aircraft.

The installation of line-segment 8 slope, angle f, measuring and recording system is shown in FIG. 10. Angle f sensor 26 includes any of a variety of perfected devices for measuring angles. Angle f sensor 26 and angle f recorder 30, shown in FIG. 10, are mounted on portion 2A of the body of the tethered aircraft, kite 2, FIG. 1. Angle f sensor 26 inputs measurements of angle f via conductors 28 to angle f recorder 30. Towing-point F is the vertex of angle f. Point F and angle f are within coplane MN, FIG. 4. In equilibrium flight, angle f is the angle between line 8, FIGS. 4, 5, and 10, and the horizon. The terminal side of angle f is line-segment 8, which rotates with the body of the aircraft around point F, FIG. 10. Line 26A is parallel to line 8 and 90°-f from vertical. The horizon, the fixed initial side of angle f, is accomplished, by pendulum 32 with bob 32A as shown as part of sensor 26, FIG. 10.

EXISTENCE OF THE PROPERTY

In his definition of the central axis, C. F. Marvin includes the weight. Whereas, here, the weight is excluded from wind-resultant force R. In this method the location of the action line of R alone is found, without including weight W in R. Weight W is never a component of wind-resultant R. Wind-resultant R includes wind forces and only wind forces.

The location of Marvin's central axis R relative to the structure of a kite is not a property of the kite. Whenever towing-point F is located at any one location of a range of towing-point locations relative to the windward face of a kite, the kite will fly in force equilibrium. Whenever towing-point F is located within the range, central axis $R_o$ and the tether center line, tether 4, FIG. 2, are collinear, so that central axis $R_o$ is associated with the tether, not the body of the kite. Central axis $R_o$ is a property of the tether; not a property of the kite. Therefore the location of central axis $R_o$ corresponds only to the towing-point location, and, consequently, the location of central axis $R_o$ is not a property of the kite.

But the location of wind-resultant R is a property of the kite, unlike the location of central axis $R_o$ that is not a property. The valuable advantageous realization, that the location of resultant R is a property of a kite, is the crucial basis of this method for locating the resultant of wind effects on tethered aircraft.

For every airfoil there exists an aerodynamic center, a.c., about which the moment of the air forces remains constant as the angle of attack is changed. The wind-resultant force R acts at or near the a.c. The a.c. is located at a constant distance in back of the leading edge of the airfoil as the angle of attack is changed.

A tethered aircraft, a kite, is supported aloft by wind striking against a multiplicity of rigidly interconnected, airfoil-like surfaces, each having its own resultant acting at or near its a.c. The location of each resultant is constant however the angles of attack are changed.

Marvin recalls from ordinary text books: "Any system of forces acting upon a rigid body may always be reduced to a single resultant force having a definite and determinate position. The kite is a body which is rigid within the present meaning, and, when flying, is acted upon by a complex system of forces."

By text book principles of mechanics the many separate resultants of wind forces, each one of which acts upon one of the multiplicity of surfaces of a kite at or near the a.c., are reducible to a single resultant wind force, R, having a definite and determinate position relative to the body of the kite.

Moreover and conclusively, single wind-resultant R is thus a property of the kite for it continues to have the same single definite and determinate position relative to the body of the kite for every angle of attack.

"A kite is a tethered aircraft flying in a stalled state," David Pelham, The Penguin Book of Kites, 1976. In stalled flight aerodynamic circulation effects are nil.

Assume that each surface of a kite is equivalent to an inclined flat plate and assume that the horizontal wind that strikes the inclined plate is a jet whose cross section is the same as the horizontal projection of the inclined plate. Wind energy loss due to impact, edge effects, and friction are taken to be small, and, hence, the momentum of the exiting wind is essentially unchanged from that of the striking wind. Then the force exerted on the plate is normal to it.

Each element of area dA of the inclined plate is subjected to the same wind pressure intensity p. By text book fluid mechanics, Victor L. Streeter, McGraw-Hill, "the elemental forces pdA acting on dA are all parallel and in the same sense."The elemental forces pdA are distributed forces. "The moment of the resultant must equal the moment of the distributed force system about any axis." Hence, the resultant passes through the centroid of the area.

The resultant passes through the centroid of the plate regardless of the angle of attack. So that it is seen that the resultant force is at the same single definite point of a surface for any angle of inclination of the surface with respect to the wind.

A kite is an assembly of such surfaces supported by wind forces. The forces on the assembly of separate surfaces are reduced to a single wind-resultant R at a location that is unchanging relative to the body of the kite for every angle of attack.

The location of wind-resultant R is therefore a property of a kite, a tethered aircraft, to be found by application of this method. It is iterated; wind-resultant R is a property of a kite whereas Marvin's central axis $R_o$ is not a kite property.

Coplanar Concurrent Forces

C. F. Marvin's intention in his monograph was to present a general theory of the evolutions that a kite flys, which evolutions are excursions between equilibrium states. During excursions most or all the separate forces on a kite are not coplanar. Being concerned with evolutions of kite flight, Marvin was not concerned whether or not the forces were coplanar at equilibrium, for even if most or all the separate forces are not coplanar his intention remained to show that a single equivalent force on a kite is to be found by the application of the principles of mechanics.

Because Marvin was concerned to avoid the restriction of any of the forces to any one plane, vertical or otherwise, in order to support these claims, it is necessary to prove that with which C. F. Marvin was not concerned; that is, it is necessary to demonstrate in the following that the three forces, T, W, and R, on a kite flying in equilibrium are also in equilibrium and are indeed coplanar and concurrent.

The first part of this following demonstration shows that in equilibrium flight wind-resultant R intersects line-segment 8, FIGS. 4, 5, and 6. It can then be, and is, shown in the second part of this demonstration, again at equilibrium, that wind-resultant R is coplanar with tether-tension T and weight W. Lastly, by the principles of mechanics, it is realized that the concurrence of the forces is a consequence of coplanarity, because, if three coplanar forces are in equilibrium, their lines of action must intersect in a common point, point C, FIGS. 3, 4, and 5.

If it is supposed that the negatively directed line-of-action of tension T does not intersect the plumb line through cg, at point C, then there exists a moment arm between the plumb line and the upwardly vertical component of tension T so that a couple rotates the kite. To fly at equilibrium all couples must vanish, hence the moment arm between a vertical component of T and the plumb line must be zero. Consequently, at equilibrium, the prolonged action line of tension T intersects the plumb line at point C, FIG. 3.

Firstly, in equilibrium flight the line of action of wind-resultant R intersects line-segment 8, for, if wind-resultant R did not intersect line 8, a couple would act upon the kite and cause it to rotate. If the kite is in rotation then the flight is not in equilibrium. During flight from an initial equilibrium state to a final equilibrium state there are unbalanced forces on a kite. During this excursion the kite will be seen to rotate, and wind-resultant R does not intersect line 8, FIG. 7; a couple acts upon the kite. The forces, tether-tension T and weight W, are replaced by the single force $R_{T\&W}$, shown as the dashed line in FIG. 7. Thus, the one force of the couple is wind-resultant R and the other force is $R_{T\&W}$. The line-of-action of force $R_{T\&W}$is so taken that it intersects line 8, however the kite flys, whether or not the kite is in equilibrium. Also, the single force $R_{T\&W}$ is so taken that it is equal, parallel, and oppositely directed to wind-force R whether or not the action line of force R intersects line-segment 8, FIG. 7.

The moment arm of the couple is the common perpendicular, line 34 in FIG. 7, between forces R and $R_{T\&W}$. At the final equilibrium state the kite is necessarily without rotation, and, hence, all couples that act upon the kite have vanished, are zero. But from one equilibrium state to the next, the magnitudes of independent wind-resultant R and force $R_{T\&W}$ are substantially unchanged. Force $R_{T\&W}$ is unchanged, because its components, weight W and dependent tether-tension T, are nearly constant.

Since the forces of the couple continue to exist unchanged and yet at equilibrium the couple has vanished, is zero, it follows that it is the moment arm 34 of the couple that has vanished, and therefore wind-resultant R intersects line 8 at point J, whenever the kite flys in force equilibrium, FIGS. 5 and 6.

In this second part of this demonstration it is explained that, when a kite flys in equilibrium, wind-resultant R lies within vertical coplane MN. Line-segment 8 is within coplane MN, FIG. 4. It is explained above and shown, FIGS. 5 and 6, that the action line of wind-resultant R intersects line 8 at point J. Then point J is within coplane MN, since line 8 is within coplane MN. Wind-resultant R is a component of central axis $R_o$, for $R_o$ is resolved into R and W at point C on the action line of W in coplane MN, FIGS. 3 and 4. Hence, because point J and point C lie within coplane MN and because these two points lie on the action line of wind-resultant R, it follows that wind-resultant R is within coplane MN.

Therefore, the vectors, T, W, and R, are indeed coplanar and concurrent.

The Property, Wind-resultant R

The coordinate axes superposed on the image of coplane MN are indexed to a structural member such as a longeron or a spar of the aircraft. The coordinate axes of the image of coplane MN and the location within MN of wind-resultant R remain unchanged in subsequent flights flown at different angles of attack, eventhough the location of towing-point F is moved from place to place, provided that sustaining surfaces are neither increased or decreased nor altered in form or position and provided that the location of the center-of-gravity is not altered by addition or removal or relocation of weight. Once the location of resultant R is found it continues to be unchanged, eventhough, due to relocations of points F and or cg, the initial line-segment 8 is abolished and, consequently, ceases to be a reference line for the location of resultant R. The location of wind-resultant R is a property of the tethered aircraft.

Operation of the Method

The location of wind-resultant R is determined when weight W, length L, slope f, tether-tension T, and tether-inclination β, are known for a flight in stall in force equilibrium in a steady wind.

To fly any tethered aircraft it is necessary to first select a site for the towing-point. Because the selection needs to be performed for flight of any and all tethered aircraft, the selected towing-point site is not an element that is specific to a particular aircraft and, hence, is not specific to this method invention. All measuring and recording instrumentation is installed. A series of trial flights guide the subsequent, arbitrary selection of a site on a tethered aircraft of a towing-point, point F, all FIGS. It is convenient to superpose coordinates on the image of coplane MN, FIG. 4. Point F is located by its coordinates, FIGS. 5 and 6. For the location of point F to be valid it is necessary to record the coordinates when bridle 6 is taut in its in-flight, spanwise, right-to-left position. The right-to-left position is chosen by inspection, however an in-flight, right-to-left, aligning mechanism will more certainly locate point F within coplane MN. Typically, in coordinate form, point F is $F(X_1, Y_1)$ on the image of coplane MN, FIGS. 4, 5, and 6.

The weight of the instrumented aircraft is recorded. The weight of all items mounted on the top end of tether 4 near towing-point F, or at towing-point F, or on the body of the aircraft are included in weight W.

The location of the center-of-gravity cg of the instrumented aircraft is recorded. The aircraft is suspended from several points on the aircraft. The location of cg is at the intersection of the prolonged vertical lines of action of weight W that pass through the several suspension points. Typically, in coordinate form, the location of cg is the point $cg(X_2, Y_2)$ in the image of coplane MN, FIGS. 4, 5, and 6.

Having, arbitrarily by trial, located towing-point F, and having located center-of-gravity cg, length L of line-segment 8 is measured directly and recorded, if there are no interferences between points F and cg. Where there are interferences it is convenient to utilize the coordinates of the points F and cg that are within the image of coplane MN, FIG. 5, in the length formula to calculate length L of line-segment 8, FIGS. 4, 5, and 6. The advantages of utilization of the coordinates are that records of the locations of points F and cg may be retained for further uses. Also if line 8 is obstructed by structure or sustaining surface, the coordinate system overcomes the need to perform awkward direct measurements of length L.

Equilibrium forces are coplanar within vertical plane MN. Line-segment 8, FIG. 4, is between towing-point F and center-of-gravity cg. Line 8 lies within the vertical plane, coplane MN, since the points F and cg lie on their action lines within the plane. In equilibrium flight the lines of action of the forces cross through a single point, the concurrent point C, FIGS. 3, 4, and 5. In equilibrium flight the action line of the resultant R crosses through the concurrent point and, also, intersects interconnecting line-segment 8 at point J, FIGS. 5 and 6. So that the line-of-action of wind-resultant force R is located within coplane MN.

While the aircraft flys in stall in force equilibrium in a steady wind, slope f, tether-inclination β, and tether-tension T are measured and recorded by actuation of on board sensing systems and essential ground support and observational apparatus, FIG. 8, 9, and 10.

If the recorded values of one or two or all three of the variables are constant during a period of flight then it may be concluded that the aircraft flew in equilibrium in a nearly steady wind, a wind whose direction and velocity were unchanging during the period; the record of constant values of the variables, T, β, and f, are assigned to a valid set of measurements.

As an aircraft climbs from the ground to equilibrium altitude or as the wind velocity falls and the aircraft descends from a high altitude to a lower altitude, the values of the recorded variables change. The values of the variables recorded during the period of changing values are rejected, for, within this period of change, the tethered aircraft has not flown in equilibrium and the changing, recorded values can not be used to form a valid set.

A valid set of variables includes weight W and length L that are measured and recorded while the aircraft is on the ground and also includes slope f, tether-tension T, and inclination-angle β, that are measured and recorded while the aircraft is aloft.

The valid sets of recorded variables are transferred among storage devices; any of a variety of actuated calculator mechanisms are operated on the valid sets of recorded measurements for the determination of the location of the line-of-action of the wind-resultant force on or within the structure of the tethered aircraft. The mechanisms may be analog or digital or combinations of analog and digital devices.

Coordinate axes referenced to the structure of the aircraft are superposed on coplane MN, FIGS. 4, 5 and 6. Upon actuation, the calculator mechanism provides coordinate points on the action line of resultant R. These located coordinate points are scaled to the aircraft structure and marked on or within the structure of the tethered aircraft. The line-of-action of resultant R is located by the marked points.

The line-of-action of wind-resultant force R is at intersection J which is distance S along line-segment 8 from center-of-gravity cg, FIG. 6. The angle between resultant R and line 8 is ω. Thus the resultant R is located with respect to line 8.

Line-segment 8 is referenced to the structure by the coordinate axes, and resultant R is located with respect to line 8, so that resultant R is also located with respect to the body of the aircraft. Thus, the purpose of this method is accomplished, the line-of-action of wind-resultant R is located relative to the body of the tethered aircraft, FIGS. 5 and 6.

Ramifications and Scope

The location of the line-of-action of the wind-resultant force is a property of the tethered aircraft. For a tethered aircraft that flies in equilibrium; whatever the angle of attack, once the location of the line-of-action of resultant R is marked on the structure, resultant R remains fixed relative to the structure, however, within a range, the site of the towing-point or the weight distribution is altered.

The description above should not be construed as limiting the scope of the invention but as merely providing illustrations of some of the presently preferred embodiments of this invention. The method herein this invention is applicable to any kite, tethered propeller or jet powered fixed or rotary wing aircraft, towed glider, or towed balloon. Many other modifications of the above steps and associated apparatus may be conceived.

The scope of the invention should be determined by the appended claims and their legal equivalents, rather than by the examples given.

What is claimed is:

1. A method for the determination of the location, relative to the structure of a tethered aircraft, of the line-of-action of the wind-resultant force of the lifting and dragging wind forces on said tethered aircraft flying in stall in force equilibrium, with said aircraft having the tether fastened to said aircraft at a previously sited towing-point comprising the steps of:

(a) while said tethered aircraft is on the ground;
- the center-of-gravity relative to said structure of said tethered aircraft is located, and
- the weight of said tethered aircraft is measured and recorded, and
- the length of the line-segment that extends from said center-of-gravity to said towing-point is measured and recorded, and (b) while said tethered aircraft flys in stall in force equilibrium in a steady wind;
- the slope of said line-segment is measured and recorded, and, proximally to the end of said tether that is fastened to said tethered aircraft at said towing-point,
- the tether-tension is measured and recorded, and
- the tether-inclination angle is measured and recorded, and (c) calculator means for locating coordinate points, relative to said structure, are operated on the records of said weight, said length, said slope, said tether-tension, and said tether-inclination to locate a plurality of said points on said line-of-action of said wind-resultant force, and (d) the located said points are placed on or within said structure of said tethered aircraft, through which said points said line-of-action of said wind-resultant force is marked on or within said structure Whereby a property of said tethered aircraft, said location of said wind-resultant force on or within said structure, is known; once marked, whatever the angle of attack, said location remains fixed relative to said structure, however, within range, the site of said towing-point or the weight distribution is altered.

2. The method of claim 1 wherein said records of said weight, said length, said slope, said tether-tension, and said tether-inclination, are operated on by calculator means for finding the distance along said line-segment from said center-of-gravity to the intersection of said line-of-action of said wind-resultant force and said line-segment and for finding the angle of said intersection.

3. The method of claim 2 wherein a coplane having coordinate axes referenced to said structure of said tethered aircraft is determined by the intersecting said line-of-action of said wind-resultant force and said line-segment.

4. The method of claim 3 wherein points on said line-of-action of said wind-resultant force that is within said coplane are imaged on or within said structure of said tethered aircraft, through which said points said line-of-action of said wind-resultant force is marked on or within said structure.

5. The method of claim 1 wherein measuring and recording means for tether-tension measuring and recording are mounted on said tether of said tethered aircraft proximally to said end of said tether that is attached to said tethered aircraft at said towing-point.

6. The method of claim 1 wherein measuring and recording means for tether-inclination angle measuring and recording are mounted on said tether of said tethered aircraft proximally to said end of said tether that is attached to said tethered aircraft at said towing-point.

7. The method of claim 1 wherein measuring and recording means for measuring and recording said slope of said line-segment that extends from the center-of-gravity of said tethered aircraft to said towing-point are mounted on said tethered aircraft.

8. A method for the determination of the location, relative to the structure of a tethered-aircraft, of the line-of-action of the wind-resultant force of the total pressure effect of the wind upon said structure of said tethered aircraft which said pressure effect is one of two components of the combined effect of all of the independent forces on said tethered aircraft, the other component being the weight of said tethered aircraft acting through the center-of-gravity, the line-of-action of said combined effect being the central axis, said combined effect is equal, opposite, and collinear with the dependent restraining pull, the tension in the tether, whenever said forces on said tethered aircraft are coplanar and concurrent in force equilibrium, with said aircraft having the tether fastened to said aircraft at a previously sited towing-point comprising the steps of:

(a) while said tethered aircraft is on the ground;

said center-of-gravity relative to said structure of said tethered aircraft is located, and said weight of said tethered aircraft is measured and recorded, and the length of the line-segment that extends from said center-of-gravity to said towing-point is measured and recorded, and (b) while said tethered aircraft flys in stall in force equilibrium in a steady wind;

the slope of said line-segment is measured and recorded, and, proximally to the end of said tether that is fastened to said tethered aircraft at said towing-point, the tether-tension is measured and recorded, and the tether-inclination angle is measured and recorded, and (c) calculator means for locating coordinate points, relative to said structure, are operated on the records of said weight, said length, said slope, said tether-tension, and said tether-inclination to locate a plurality of said points on said line-of-action of said wind-resultant force, and (d) the located said points are placed on or within said structure of said tethered aircraft, through which said points said line-of-action of said wind-resultant force is marked on or within said structure Whereby a property of said tethered aircraft, said location of said wind-resultant force on or within said structure, is known; once marked, whatever the angle of attack, said location remains fixed relative to said structure, however, within range, the site of said towing-point or the weight distribution is altered.

9. The method of claim 8 wherein said records of said weight, said length, said Slope, said tether-tension, and said tether-inclination, are operated on by calculator means for finding the distance along said line-segment from said center-of-gravity to the intersection of said line-of-action of said wind-resultant force and said line-segment and for finding the angle of said intersection.

10. The method of claim 9 wherein a coplane having coordinate axes referenced to said structure of said tethered aircraft is determined by the intersecting said line-of-action of said wind-resultant force and said line-segment.

11. The method of claim 10 wherein points on said line-of-action of said wind-resultant force that is within said coplane are imaged on or within said structure of said tethered aircraft, through which said points said line-of-action of said wind-resultant force is marked on or within said structure.

12. The method of claim 8 wherein measuring and recording means for tether-tension measuring and recording are mounted on said tether of said tethered aircraft proximally to said end of said tether that is attached to said tethered aircraft at said towing-point.

13. The method of claim 8 wherein measuring and recording means for tether-inclination angle measuring and recording are mounted on said tether of said tethered aircraft proximally to said end of said tether that is attached to said tethered aircraft at said towing-point.

14. The method of claim 8 wherein measuring and recording means for measuring and recording said slope of said line-segment that extends from said center-of-gravity of said tethered aircraft to said towing-point are mounted on said tethered aircraft.

* * * * *

UNITED STATES PATENT AND TRADEMARK OFFICE

CERTIFICATE OF CORRECTION

PATENT NO. : 5,533,694
DATED : July 9, 1996
INVENTOR(S) : Howard G. Carpenter

It is certified that error appears in the above-indentified patent and that said Letters Patent is hereby corrected as shown below:

Col. 4, line 53, after "line-of-action" insert "--is--".

Col. 6, line 58, at the beginning of line 58, insert the symbol "S--".

Col. 7, line 29, change R to "--$R_o$--".

Col. 9, line 33, change R to "--$R_o$--".

Signed and Sealed this

Twenty-ninth Day of October 1996

*Attest:*

Bruce Lehman

BRUCE LEHMAN

*Attesting Officer*

*Commissioner of Patents and Trademarks*